US008151807B2

(12) United States Patent
Holloway et al.

(10) Patent No.: US 8,151,807 B2
(45) Date of Patent: Apr. 10, 2012

(54) BRUSH ASSEMBLY WITH MOLDED BRUSH SLEEVE

(75) Inventors: Thomas F. Holloway, Southbury, CT (US); Frederick J. Dobbins, Prospect, CT (US); Stephen G. Dudienski, Ansonia, CT (US); Raymond P. Legassie, Laconia, NH (US)

(73) Assignee: HCP Packaging USA, Inc., Shelton, CT (US)

( * ) Notice: Subject to any disclaimer, the term of this patent is extended or adjusted under 35 U.S.C. 154(b) by 526 days.

(21) Appl. No.: 12/324,322

(22) Filed: Nov. 26, 2008

(65) Prior Publication Data

US 2009/0293900 A1 Dec. 3, 2009

Related U.S. Application Data

(60) Provisional application No. 60/990,054, filed on Nov. 26, 2007.

(51) Int. Cl.
*A45D 40/26* (2006.01)

(52) U.S. Cl. ..... 132/218; 15/176.1

(58) Field of Classification Search ..... 15/176.1, 15/176.6, 202; 132/218, 320
See application file for complete search history.

(56) References Cited

U.S. PATENT DOCUMENTS

| | | | | |
|---|---|---|---|---|
| 702,359 | A | 6/1902 | Durston | |
| 4,291,431 | A | 9/1981 | Lewis, Jr. | |
| 4,411,282 | A | 10/1983 | Wavering | |
| 4,446,880 | A | 5/1984 | Gueret et al. | |
| 4,498,490 | A | 2/1985 | Seidler | |
| 4,545,393 | A | 10/1985 | Gueret et al. | |
| 4,565,205 | A | 1/1986 | Taylor | |
| 4,635,659 | A | 1/1987 | Spatz | |
| 4,964,429 | A | 10/1990 | Cole | |
| 5,123,431 | A | 6/1992 | Wilson | |
| 5,137,038 | A | 8/1992 | Kingsford | |
| 5,722,436 | A | 3/1998 | Vandromme | |
| 5,816,728 | A | 10/1998 | Nardolillo et al. | |
| 5,826,600 | A | 10/1998 | Rowe | |
| 6,260,558 | B1 | 7/2001 | Neuner | |
| 6,345,626 | B1 | 2/2002 | Bouix | |
| 6,371,130 | B1 * | 4/2002 | Vasas | 132/218 |
| 6,616,366 | B1 | 9/2003 | Weihrauch | |
| 6,691,716 | B2 | 2/2004 | Neuner | |
| 7,121,284 | B2 | 10/2006 | Gueret | |

(Continued)

FOREIGN PATENT DOCUMENTS

| | | |
|---|---|---|
| DE | 3501098 | 7/1986 |

(Continued)

*Primary Examiner* — Rachel Steitz
(74) *Attorney, Agent, or Firm* — O'Connell Law Firm

(57) ABSTRACT

A brush assembly with an applicator rod, a brush sleeve with a tubular core member and a plurality of bristles, a rod hole in the distal end of the applicator rod, and a rivet for being received into the rod hole to retain the brush sleeve. A peripheral retaining wall can retain and protect a proximal end of the brush sleeve. The brush sleeve can have radially projecting, diamond-shaped bristles and can be slidably received over a body portion of the rivet or over a support stem forming a distal portion of the applicator rod. The body portion of the rivet or the support stem can have a non-circular cross section or an arcuate longitudinal profile to induce the brush sleeve to have the non-circular cross section or acruate longitudinal profile. A method for producing brush assemblies can produce brush assemblies with brush sleeves of varied cross sections.

21 Claims, 8 Drawing Sheets

U.S. PATENT DOCUMENTS

| | | | | |
|---|---|---|---|---|
| 7,162,767 | B2 | 1/2007 | Pfenniger et al. | |
| 7,325,550 | B2 | 2/2008 | Eckers et al. | |
| 7,581,546 | B2 | 9/2009 | Dumler | |
| 2006/0042647 | A1* | 3/2006 | Vogel | 132/218 |
| 2007/0033760 | A1* | 2/2007 | Dumler | 15/187 |
| 2007/0062551 | A1* | 3/2007 | De Brouwer et al. | 132/218 |
| 2007/0062552 | A1* | 3/2007 | De Brouwer et al. | 132/218 |

FOREIGN PATENT DOCUMENTS

| | | |
|---|---|---|
| DE | 19911763 | 9/2000 |
| EP | 0038524 | 4/1981 |
| EP | 0193059 | 9/1986 |
| EP | 1752063 | 2/2007 |
| FR | 2890837 | 3/2007 |
| FR | 2900319 | 11/2007 |
| GB | 1221793 | 2/1971 |
| WO | WO00/54623 | 9/2000 |
| WO | WO02/07563 | 6/2002 |
| WO | WO02/056726 | 7/2002 |
| WO | WO2007/125207 | 11/2007 |

* cited by examiner

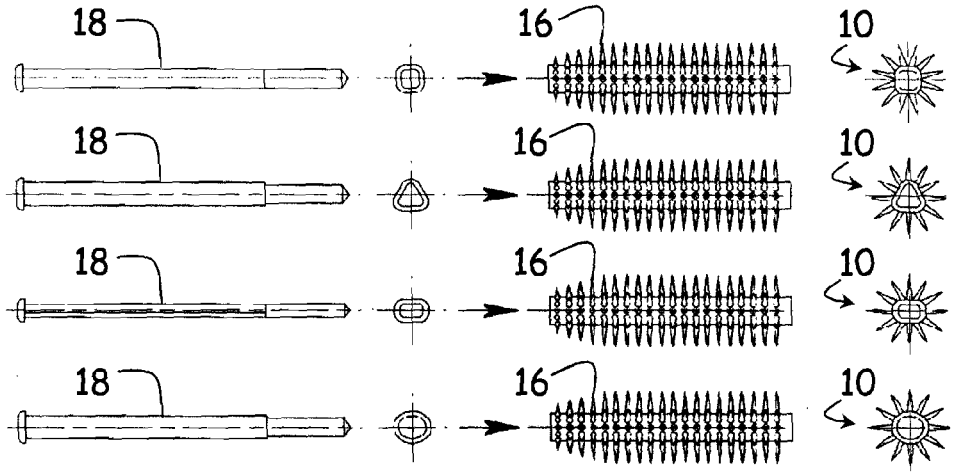
FIG. 12A
FIG. 12B
FIG. 12C
FIG. 12D
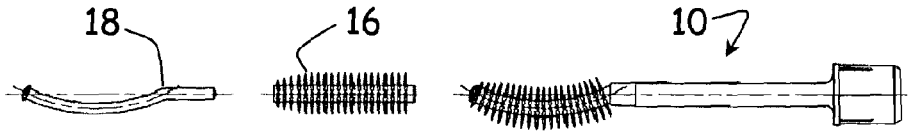
FIG. 13
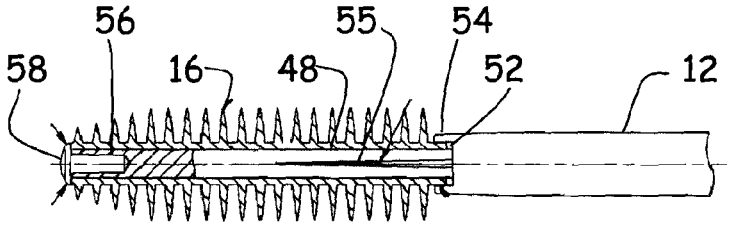
FIG. 14

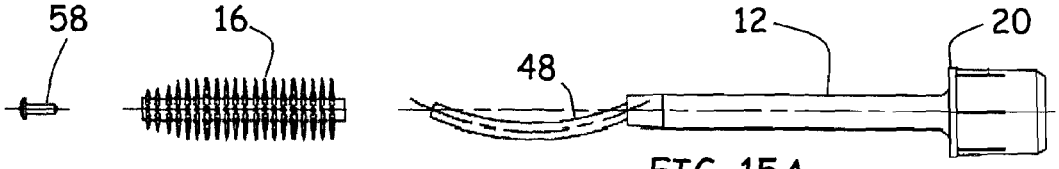
FIG. 15A
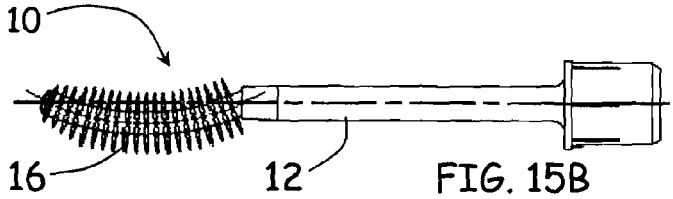
FIG. 15B
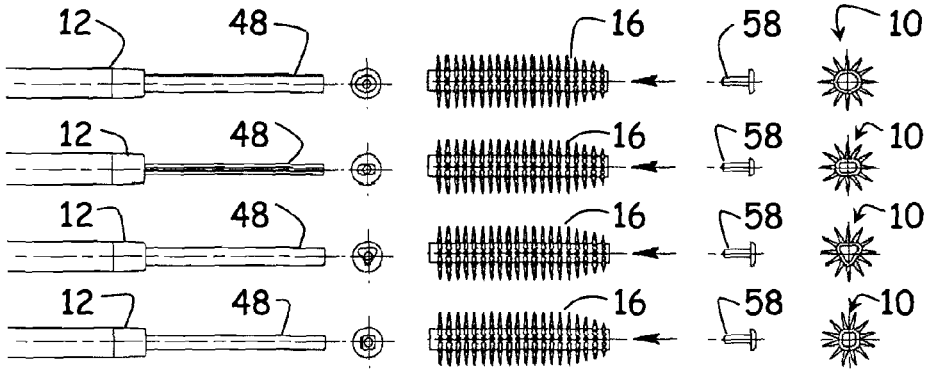
FIG. 16A
FIG. 16B
FIG. 16C
FIG. 16D

BRUSH ASSEMBLY WITH MOLDED BRUSH SLEEVE

PRIORITY CLAIM

This application claims priority to U.S. Provisional Patent Application No. 60/990,054, filed Nov. 26, 2007.

FIELD OF THE INVENTION

The present invention relates generally to brush constructions. More particularly, disclosed and protected herein is a manufacturing technique and a brush assembly produced thereby wherein a molded brush sleeve with spaced bristles is assembled with an applicator rod and a rivet member to produce a stable and readily adaptable applicator brush capable of retaining and applying makeup product in an efficient and advantageous manner.

BACKGROUND OF THE INVENTION

In general, mascara brushes have remained fundamentally similar to the twisted wire arrangements disclosed at least as early as 1964 in, for example, U.S. Pat. No. 3,214,782. In a typical twisted wire arrangement, a plurality of individual bristles are retained between metal wires that are twisted together to form a helical core. The bristles are clamped between the wires and are flared radially outward from the core to yield a brush with a substantially round cross-section. A handle, which can comprise, or be affixed to, a cap enables a user to dip the brush into a reservoir to remove and retain a volume of the liquid or pasty material and then to apply the material by combing the brush through the user's eyelashes.

Although they have varied in the shape and material composition of the bristles, wires, and the resulting contouring of the brush, twisted wire constructions are limited in their adaptability to different materials and application goals. The bristles in a twisted wire configuration necessarily tend to follow the helical pattern of the twisted wire core, and precise control over the location and orientation of the bristles is substantially impossible. Furthermore, mascara is trapped in the gaps between the bristles thereby reducing the crispness of the application process and establishing a haven for the accumulation of debris and other impurities leading to an undesirable result know as clumping of the product. Still further, the creation of a twisted wire arrangement is an inherently complex process having complicated processing and machinery requirements. Therefore, despite attempts to modify the character of the bristles, such as with very soft bristles as taught in PCT Application No. PCT/US01/04555 and with bristles having complex cross sections as in U.S. Pat. No. 7,051,740, the essential limitations imposed by the twisted wire configuration remain.

It will also be recognized that, since mascara is typically highly viscous, it can accumulate and clump when applied to eyelashes. Clumps and excessive accumulations are normally combed out and the lashes are ideally separated in a finishing step to the application process. Stiffer bristles disposed in a pattern with wide clearances between them allow the brush to comb out clumps and properly separate lashes. Conversely, soft bristles are considered well suited to the initial application of the mascara. Accordingly, while a separate brush could be used for each function, there is a recognized and longfelt need for a single brush that is simultaneously effective in applying mascara and in combing out clumps.

A number of inventors have sought to provide a brush that meets these very different goals. For example, U.S. Pat. No. 4,861,179 teaches a brush with a combination of soft and stiff bristles, and U.S. Pat. No. 5,238,011 discloses a brush with soft yet thick bristles designed to exhibit desirable softness while avoiding being excessively supple. Unfortunately, while the resulting brushes may have had some effectiveness when initially developed, increases in viscosity and other modifications to mascara compositions have rendered such designs less than ideal. For example, their soft bristles can collapse when confronted with modern high viscosity mascara.

More recently, applicator brushes have been developed where bristle projections are molded onto a rod-shaped support. For example, in U.S. Pat. No. 6,616,366, Weihrauch described an applicator where projections that are tapered toward the distal ends thereof are fixed in relation to a rod-shaped support. The projections and the rod-shaped support can be formed as a single part from a soft elastomer. Unfortunately, while the soft elastomeric material may be preferable for the projecting bristles, forming the support from that same material can yield a brush that is excessively flexible such that it can bend and wobble during use thereby harming the application process.

Weihrauch does contemplate molding a reinforcing insert into the support and bristle fingers, but the components are inherently fixed to one another and are fixed in their relative configurations. With this, any versatility in the resulting cross sectional or longitudinal profile of the applicator is prevented. Likewise, in U.S. Pat. No. 7,325,550, Eckers et al. disclose an applicator wherein a sleeve with radially projecting, round, tapered fingers is molded over a reinforcing core. As a result, the sleeve and the core are fixed in relation to one another such that the resulting cross section and longitudinal profiles of the sleeve are unchangeable. Moreover, with disparate materials fixed to one another, a dimensional change in one component in Weihrauch or Eckers et al., such as swelling of the soft bristle material due to prolonged exposure to somewhat harsh mascara products, can cause the sleeve and the core to separate leading to poor product performance and potential danger to the user.

Furthermore, where a sleeve is to be molded directly onto such a reinforcing core, the manufacturer is inherently limited in the cross-sectional and longitudinal profiles that can be achieved. In addition to being limited to the one chosen shape, the possibilities in shape are in and of themselves inherently limited since the tooling used to produce such brush sleeves is highly complicated, particularly since the molded bristles protrude in several directions. To accommodate the molding of the bristles, the molding tool must be designed to open in multiple directions thereby imposing substantial design limitations. Adding a varied cross section or a curved or other profile to the already complex bristle molding process would push the design out of the realm of commercial reasonableness or even beyond what is possible in the primary production tool.

In light of the state of the art as summarized above, it will be appreciated that there is a need in the art for a stable yet versatile applicator for mascara and a method for manufacturing the same with varied cross-sectional and longitudinal configurations that can enable an ample volume of material to be retained while providing smooth and consistent product payoff and effective combing and separation of eyelashes.

SUMMARY OF THE INVENTION

An object of embodiments of the invention is to provide a manufacturing technique and a brush assembly produced thereby that optimize eyelash loading, application, and combing characteristics to enable the achievement of a finished appearance expeditiously in as few strokes and as few introductions of the applicator brush assembly into the mascara reservoir as possible.

A further object of particular constructions of the invention is to provide a construction method and resulting brush assembly that allow bristles to be spaced in an even geometrical array to permit superior product loading of the bristles, superior product payoff onto the eyelashes, and superior defining and lengthening characteristics.

A related object of embodiments of the invention is to provide a mascara brush assembly and method for producing the same that enables the optimal application of makeup onto lashes so that they are optimally loaded, separated, and lengthened providing an enhanced, volumized, defined, and long eyelash look.

Another object of certain embodiments of the invention is to provide a molded brush sleeve with spaced, soft bristles for assembly with a generally rigid support to produce a stable yet pliable applicator. A further object of embodiments of the invention is to provide a brush sleeve for an applicator brush that is molded with bristles spaced and aligned to provide channels for eyelashes to pass through thereby to improve the retention of product and the transfer of the same onto eyelashes.

Still another object of embodiments of the invention is to provide a brush assembly and method for producing the same that can impart a desired cross sectional and longitudinal profile shape to a standardized brush sleeve for different applications and goals.

These and in all likelihood further objects and advantages of the present invention will become obvious not only to one who reviews the present specification and drawings but also to those who have an opportunity to make use of an embodiment of the brush assembly disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the invention, one basic embodiment of the brush assembly with a molded brush sleeve is founded on an applicator rod with a proximal end for being retained by a user and a distal end for applying the product. The brush assembly has a brush sleeve with a tubular core member and a plurality of bristles that project radially from the core member. A rivet with a base portion is received into a rod hole in a distal portion of the applicator rod, and a flange on the rivet retains the brush sleeve in relation to the applicator rod.

In certain embodiments, the rivet can have a base portion for being inserted into the rod hole and a main body portion that is disposed distal to the rod hole for being slidably received through the tubular core member of the brush sleeve. The brush sleeve can have a length approximately equal to a length of the main body portion of the rivet, and the proximal portion of the brush sleeve can be received and protected by an annular, peripheral retaining wall that extends distally from the applicator rod from around the rod hole. The peripheral retaining wall can have an annular inner surface with an inner diameter sized to receive an outer diameter of the tubular core member of the brush sleeve, and the tubular core member of the brush sleeve can have an inner diameter sized to receive a longitudinally corresponding outer diameter of the main body portion of the rivet whereby the proximal portion of the brush sleeve can be sandwiched between the peripheral wall and the body portion of the rivet. To ensure the protection of the proximal end of the brush sleeve, the brush sleeve can have a length greater than a distance by which the main body portion of the rivet, exclusive of the cap or flange, projects beyond a distal end of the retaining wall when the base portion of the rivet is fully received into the rod hole. For example, the brush sleeve can be longer than the distance by which the main body portion of the rivet, exclusive of the cap or flange, projects beyond the distal end of the retaining wall by approximately the height of the retaining wall.

Under some constructions of the invention, the bristles of the brush sleeve can have a diamond-shaped cross section to improve product loading and payoff. In such embodiments, the bristles can be oriented in relation to the tubular core member with first and second opposed corners longitudinally aligned in relation to the core member and third and fourth opposed corners circumferentially aligned in relation to the core member. Further, the bristles can be disposed in symmetrical rows spaced radially around the core member, and they can be longitudinally aligned in symmetrical columns along the core member.

By use of the rivet construction having a body portion for being received through the tubular core member of the brush sleeve, varied cross-sectional and longitudinal profile shapes of the outer brush sleeve can be achieved. By way of example, the body portion can in certain cases have a non-circular cross section, such as a rounded triangular cross section, a rounded rectangle cross section, or a rounded square cross section, to cause the tubular core member of the brush sleeve to tend to pursue that same non-circular cross section. Additionally or alternatively, the body portion of the rivet can have an arcuate longitudinal profile to cause the tubular core member of the brush sleeve to pursue that same arcuate longitudinal profile.

In alternative embodiments, a support stem can comprise a distal portion of the applicator rod, and the rod hole can be formed in a distal end of the support stem. The brush sleeve can thus be slidably received onto the support stem and retained by the rivet inserted into the rod hole. The support stem can have circular or non-circular cross sections and, additionally or alternatively, arcuate longitudinal profiles to induce the brush sleeve to pursue a like configuration. A peripheral retaining wall that that extends distally from a widened shoulder at the proximal end of the support stem can again receive and protect the proximal portion of the brush sleeve.

Each of the disclosed brush assemblies can be produced under a method where one provides an applicator rod, a brush sleeve, and a rivet. The brush sleeve can be secured in relation to the applicator rod by inserting the rivet into the rod hole. In practices of the invention, at least some rivets with main body portions having circular cross sections and at least some rivets with main body portions having non-circular cross sections can be produced thereby yielding some brush assemblies with brush sleeves having circular cross sections and some brush assemblies with brush sleeves having non-circular cross sections. Similarly, where brush assemblies have a support stem comprising a distal portion of the applicator rod of each brush assembly, the support stems of at least some brush assemblies can have non-circular cross sections and the support stems of at least some brush assemblies can have circular cross sections whereby the tubular core members of the brush sleeves of those brush assemblies will tend to pursue non-circular cross and circular cross sections respectively.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The invention may be more completely understood with reference to the accompanying drawings, in which:

FIGS. 12A through 12D each depict exploded and views in front elevation of alternative rivet and brush sleeve cross sections pursuant to the present invention;

FIG. 13 is an exploded view in side elevation of a further brush assembly according to the invention;

FIG. 14 is a partially sectioned view in side elevation of a distal portion of another brush assembly as taught herein;

FIGS. 15A and 15B are exploded and assembled views in side elevation of yet another brush assembly under the current invention;

FIGS. 16A through 16D each depict exploded and views in front elevation of distal portions of brush assemblies with alternative support stem cross sections pursuant to the invention;

DETAILED DESCRIPTION OF PREFERRED EMBODIMENTS

As is the case with many inventions, the present invention for a brush assembly is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention. It will be further appreciated that, while the present discussion relates primarily to devices for enabling the retention and application of mascara and other makeup products, the assembly disclosed herein is not so limited and may be readily applied to other industries beyond the field of cosmetics.

Figure 1:
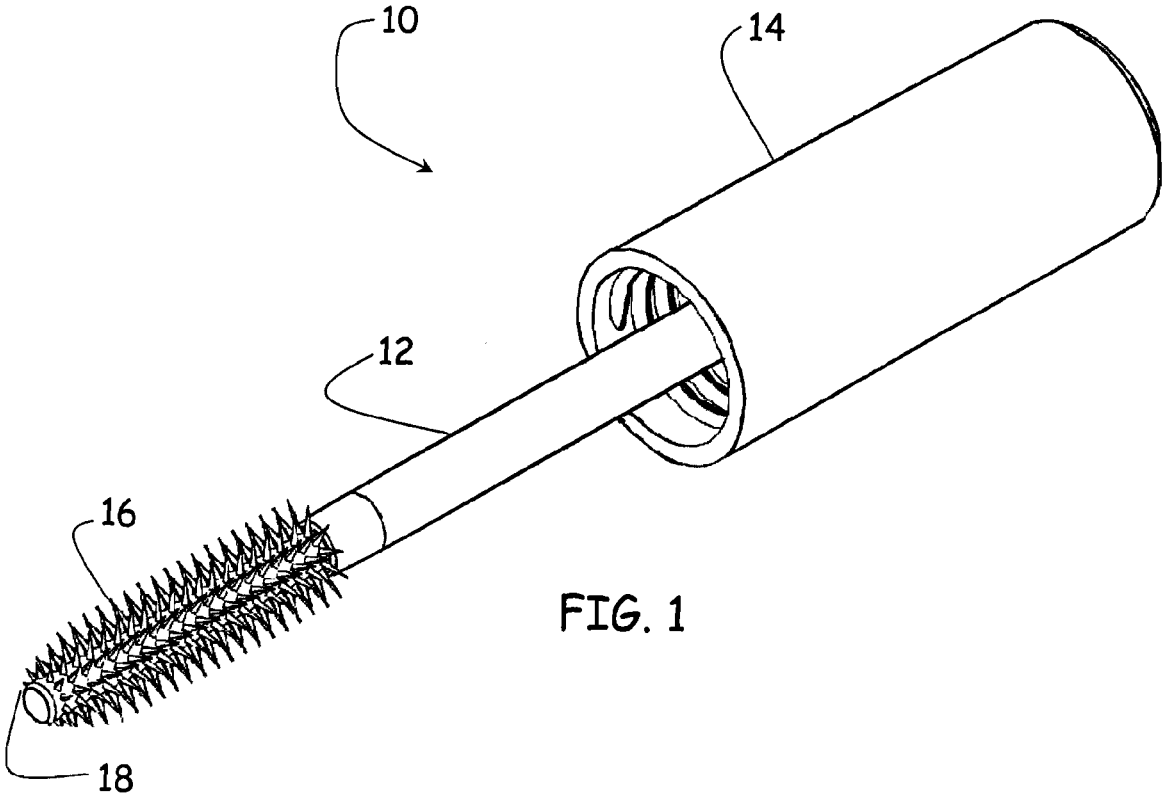
FIG. 1 is a perspective view of a brush assembly according to the invention disclosed herein.
Figure 2:
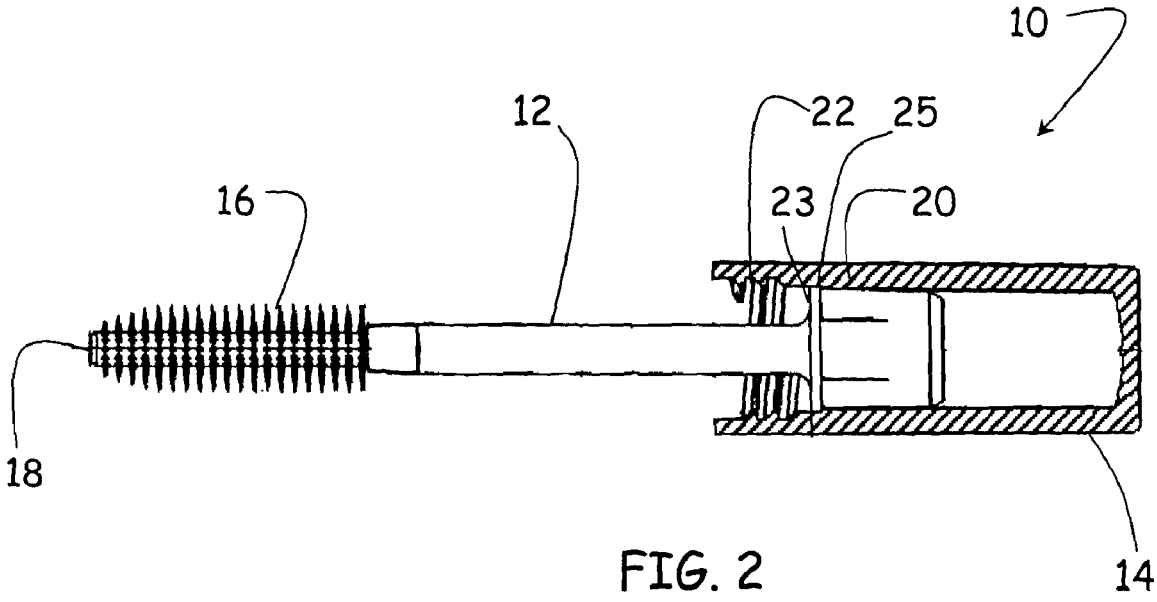
FIG. 2 is a partially sectioned view in side elevation of the brush assembly of FIG. 1.

Turning more particularly to the drawings, a brush assembly according to the present invention is indicated generally at 10 in FIGS. 1 and 2. The brush assembly 10 can be considered to be founded on an applicator rod 12 that has a proximal end for being retained by a user and a distal end for applying product, which can comprise mascara or any other liquid or pasty material. An annular cup member 20 is fixed to the proximal end of the applicator rod 12, such as by being integrally formed therewith, and a brush sleeve 16 is retained at the distal end of the applicator rod 12 for enabling the retrieval and application of a volume of liquid or pasty material, such as mascara (not shown).

Figure 4:
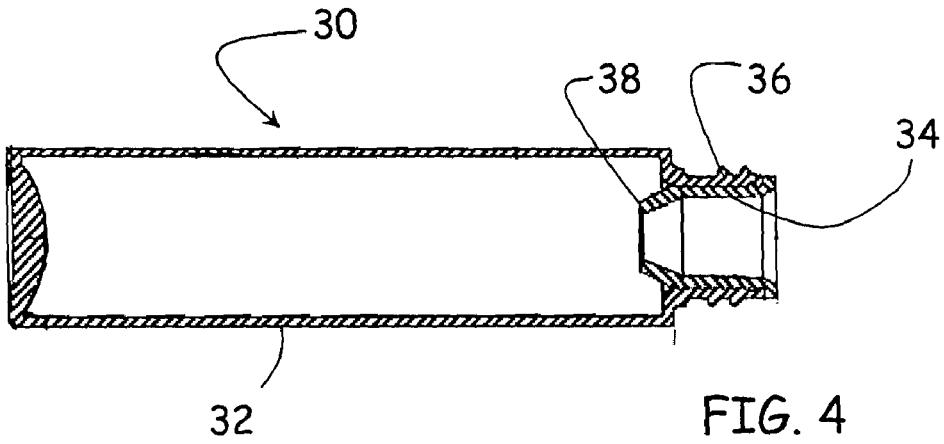
FIG. 4 is a sectioned view in side elevation of a bottle for use in relation to the brush assembly taught herein.
Figure 5:
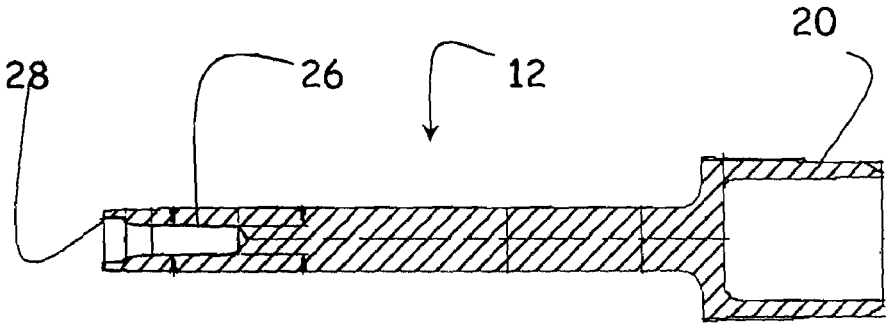
FIG. 5 is a sectioned view in side elevation of an applicator rod of the brush assembly.

A tubular cap 14 is retained at the proximal end of the applicator rod 12 by having the cup member 20 received within the tubular cap 14. An annular ridge 23 of the cup member 20 contacts an annular shoulder 25 formed in an inner wall surface of the tubular cap 14. Peripheral ribs 24 project radially from the tubular cap 14 to ensure a positive engagement between the cap 14 and the cup member 20 and to prevent relative rotation between the cap 14 and the cup member 20. The tubular cap 14 and the cup member 20 can be secured together by any effective means, including friction, mechanical engagement, adhesive, heat or sonic welding, or any other suitable method or methods. Threads 22 are disposed on the inner wall surface of the tubular cap 14 distal to the cup member 20. In use, the threads 22 engage corresponding threads 36 on a bottle 30, such as that shown in FIG. 4, that can retain a volume of liquid or pasty material (not shown). A variety of liquid or pasty materials would be possible, including mascara.

Figure 17:
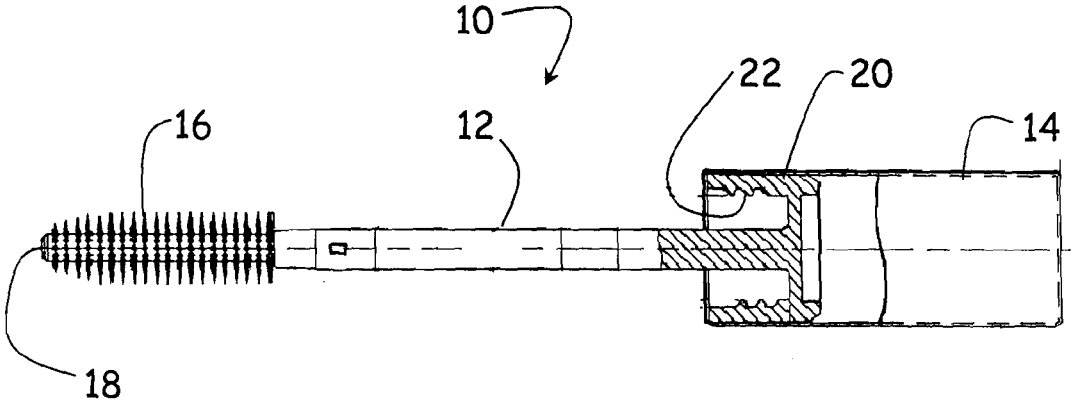
FIG. 17 is a cross sectioned view in side elevation of another brush assembly according to the invention.
Figure 18:
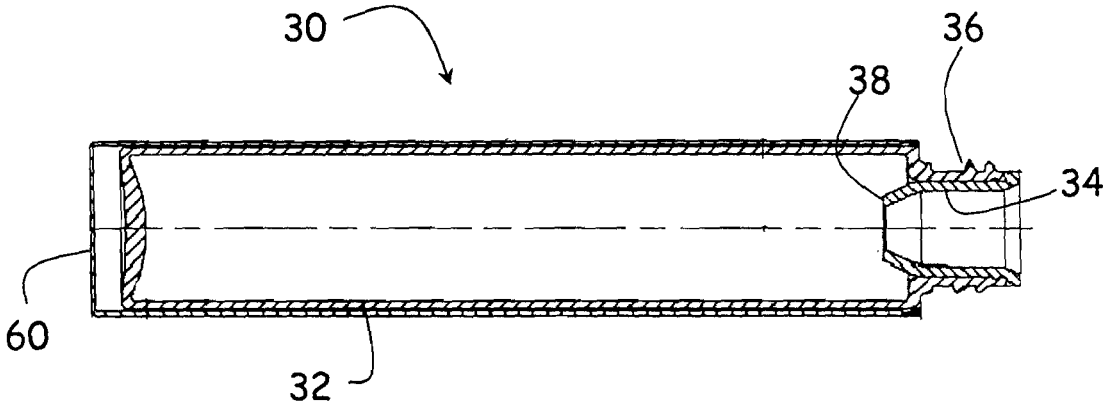
FIG. 18 is a cross sectioned view in side elevation of another bottle for use under the invention.

Of course, other configurations for the brush assembly 10 and the bottle 30 are possible and within the scope of the invention. For example, looking to FIG. 17 where an alternative brush assembly is shown, it can be seen that a cup 20 can again be fixed to the proximal end of the applicator rod 12. In this embodiment, however, the cup 20 is oppositely oriented to that shown in, for example FIG. 2, in that an open end of the cup faces distally. Further, threads 22 are disposed directly on an inner wall surface of the cup 20 for engaging corresponding threads 36 on a bottle 30, such as that shown in FIG. 18. There, the bottle 30 again has a body 32 that can be formed from a plastic or another material. Here, however, the body 32 is encased in a sleeve 60, which can be formed from a metal such as aluminum or any other suitable material. Likewise, a cap 14, which could also be formed from a metal such as aluminum, envelops the cup 20. The cap 14 can be secured in place by, for example, a hot melt adhesive.

One can gain a better understanding of one method for retaining the brush sleeve 16 relative to the applicator rod 12 by combined reference to FIGS. 2, 3, and 5 through 9. The brush sleeve 16 is founded on a tubular core member 44, and a plurality of bristles 46, which can be integrally formed in a single molding step with the tubular core member 44, project radially from the tubular core member 44. As shown in FIGS. 6A and 6B, a rivet member 18 has a main body portion 41, exclusive of the cap or flange 42, substantially equal in length to the length of the core member 44 of the brush sleeve 16 and a base portion 43 substantially equal in length to a longitudinal, concentric borehole or rod hole 26 in the distal end of the applicator rod 12.

Figure 6A:
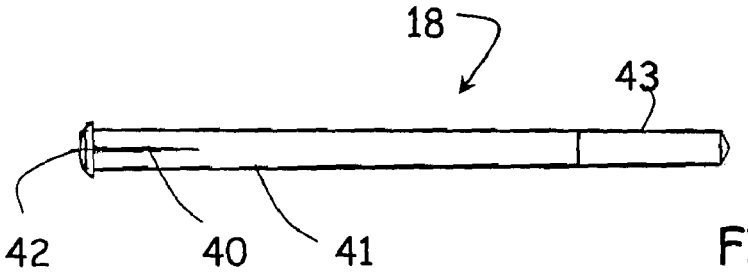
FIGS. 6A and 6B are views in side elevation of rivets for use in relation to the applicator rods disclosed herein.
Figure 6B:
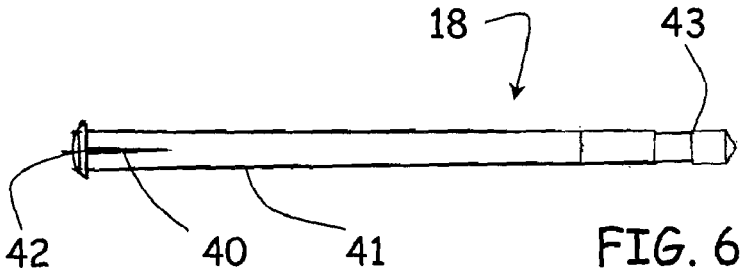
Figure 7:
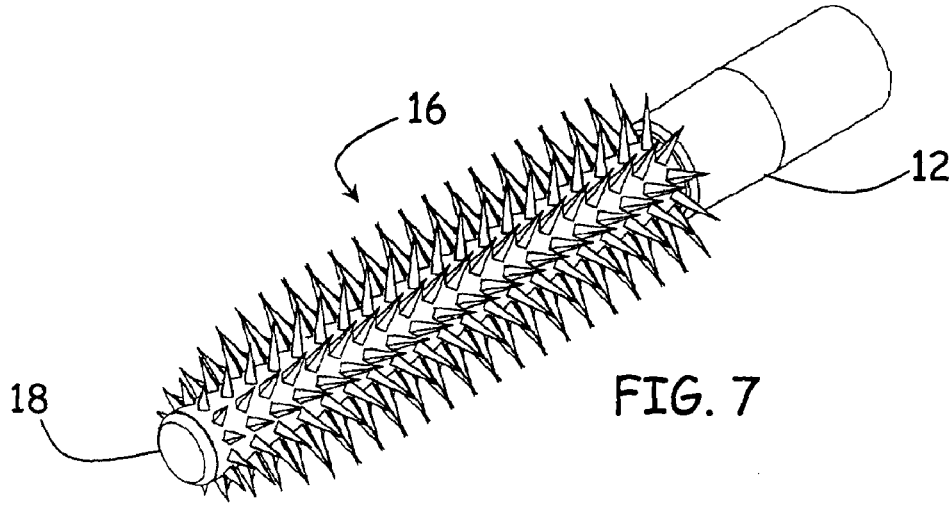
FIG. 7 is a perspective view of a brush sleeve according to the present invention.
Figure 8:
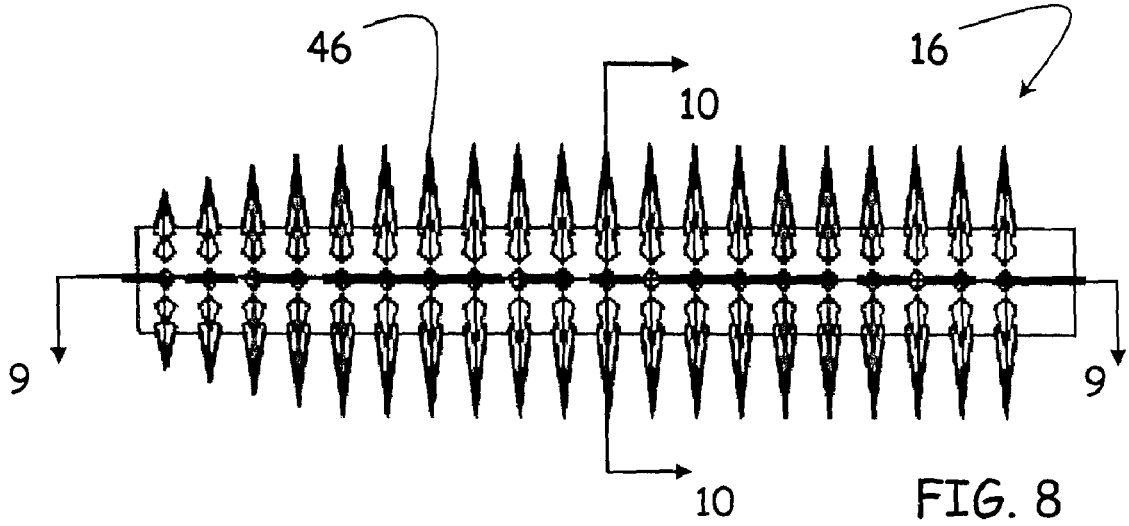
FIG. 8 is a view in side elevation of the brush sleeve of FIG. 7.
Figure 9:
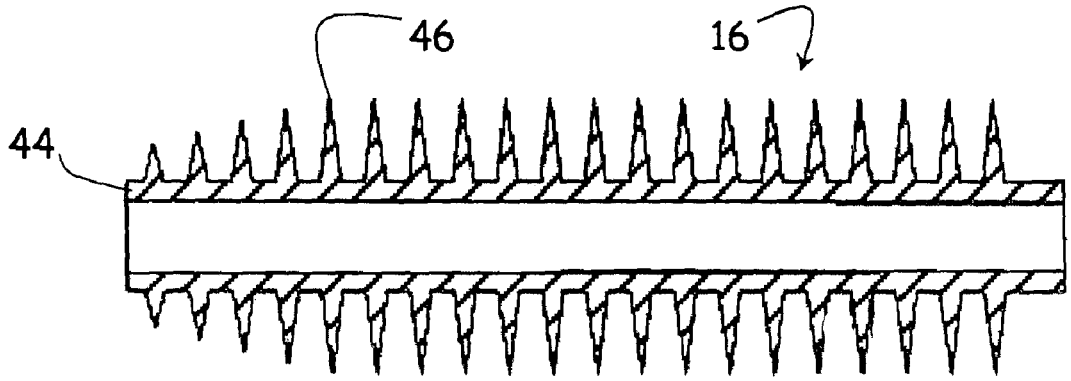
FIG. 9 is a longitudinal cross section of the brush sleeve taken along the line 9-9 in FIG. 8.
Figure 10:
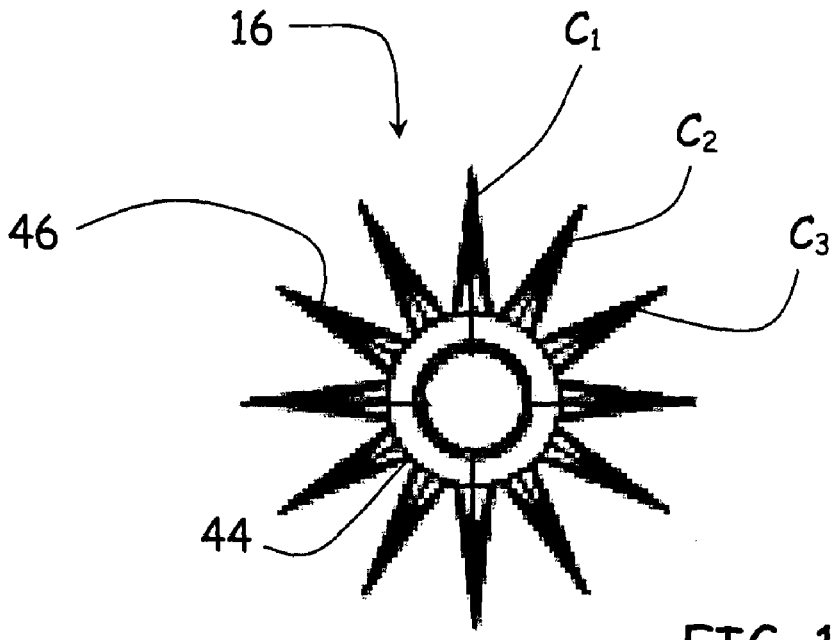
FIG. 10 to is a lateral cross section of the brush sleeve taken along the line 10-10 in FIG. 8.
Figure 11:
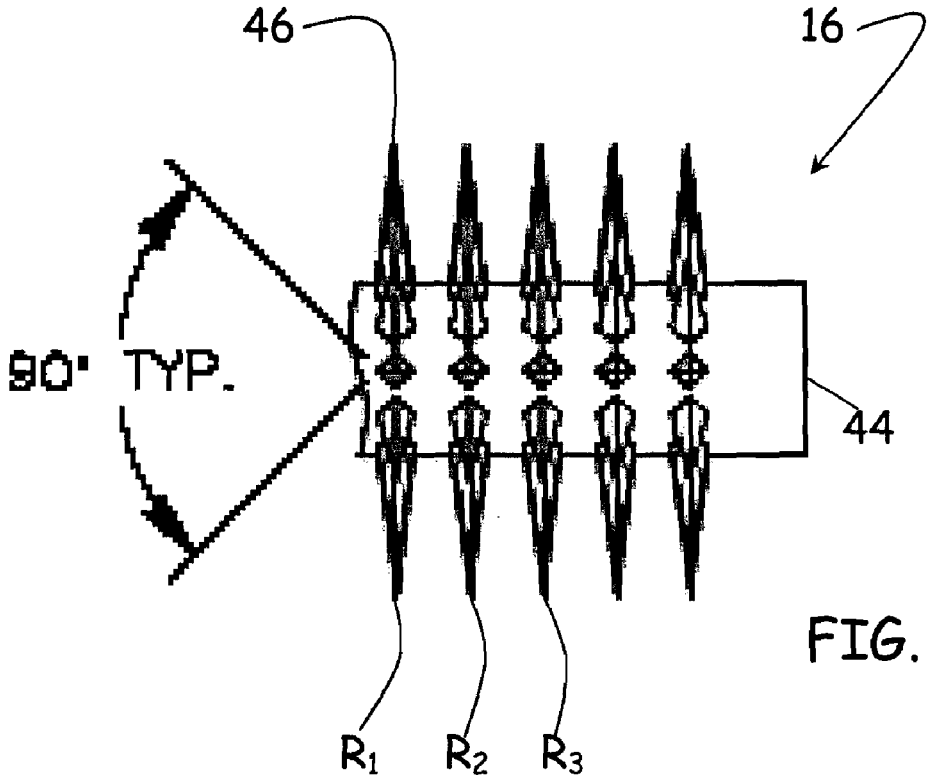
FIG. 11 is a magnified view in side elevation of a brush sleeve portion.

The base portion 43 of the rivet member 18 is sized to be received into the rod hole 26 with each terminating in a conical tip. The main body portion 41 of the rivet member 18 has a diameter within a predetermined range of the inner diameter of the brush sleeve 16 to enable the tubular core member 44 of the brush sleeve 16 and the rivet member 18 to be closely and matingly engaged as shown, for example, in FIG. 3. The flange 42 can be round with a flat proximal surface and a dome-shaped distal surface at the distal end thereof that is larger in cross section than the inner diameter of the core member 44 of the brush sleeve 16. Progressively raised ribs 40 begin along the body portion 41 and terminate at a greatest height at the flange 42 for preventing relative rotation between the brush sleeve 16 and the rivet member 18. As shown in FIG. 6B, rivets 18 according to the invention can have a base portion 43 with a narrowed portion and a broadened tip.

Figure 3:
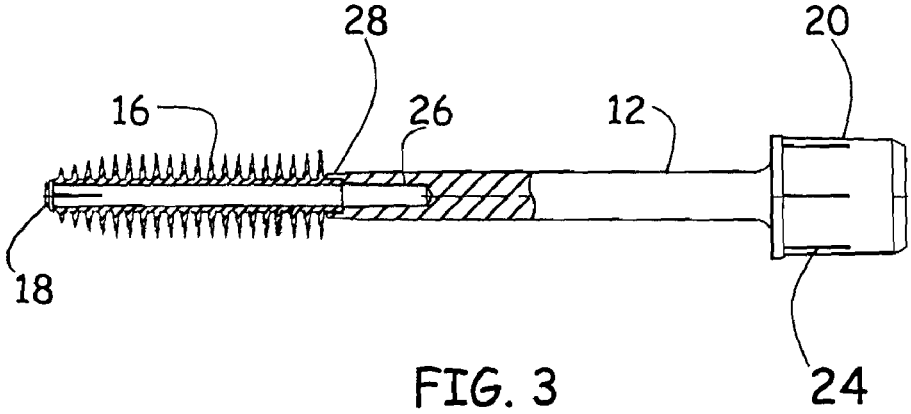
FIG. 3 is a partially sectioned view in side elevation of the brush assembly of FIG. 1 with the cap removed.

The applicator rod 12 has an annular retaining wall 28 that projects distally from adjacent to the distal end of the rod hole 26. The annular retaining wall 28 has a diameter greater than the rod hole 26 and is separated from the rod hole 26 by a shoulder. The annular retaining wall 28 has an inner diameter sized to receive therewithin the proximal end of the core member 44 of the brush sleeve 16 as shown in FIG. 3. For example, the annular retaining wall 28 can have an inner diameter slightly greater than the outer diameter of the core member 44 of the brush sleeve 16.

The core member 44 of the brush sleeve 16 has an overall length greater than the distance by which the body portion 41 of the rivet member 18, exclusive of the flange 42, projects from the distal end of the annular retaining wall 28 of the applicator rod 12 when the base portion 43 of the rivet member 18 is fully received into the rod hole 26. In one contemplated embodiment, the core member 44 is greater in length than the distance by which the body portion 41 of the rivet member 18, exclusive of the flange 42, projects from the distal end of the annular retaining wall 28 by approximately the height of the wall 28. With this, the brush sleeve 16 can be slid onto the body portion 41 of the rivet member 18, and the base portion 43 of the rivet member 18 can be inserted into the rod hole 26.

The surface of the rod hole 26 can be textured or have ribs (not shown) whereby the inner surface material of the rod hole 26 can press against or embed itself into the base portion 43 of the rivet member 18. Alternative or additional methods for retaining the rivet member 18 in place would be obvious to one skilled in the art after reading this disclosure. For example, the rivet member 18 could be secured in place by adhesive, heat or ultrasonic welding, or any other effective method or methods.

With the applicator rod 12, the brush sleeve 16, and the rivet member 18 so disposed, the proximal portion of the core member 44 will be sandwiched between the rivet member 18 and the annular retaining wall 28. During insertion into the mascara bottle 30, the bristles 46 of the brush sleeve 16 pass through a wiper 38 adjacent to the neck 34 of the bottle 30 that typically has a smaller diameter than the brush diameter. With this, only what is ideally the proper amount of product is left on the brush sleeve 16 for optimal product application. Since the inside diameter of the wiper 38 will be sliding over the end of the brush sleeve 16 during every application, it would be disadvantageous to have the edge of the brush sleeve 16 catch and possibly lift each time it passes therethrough. By protecting the proximal end of the brush sleeve 16 with the annular retaining wall 28 within or adjacent to the rod hole 26, the present construction avoids the same while also preventing mascara product from accumulating in this area after repeated uses. Consequently, dislodging and other malfunctions of the brush sleeve 16 will be prevented, and the overall appearance of the resulting brush assembly 10 will be improved.

The brush sleeve 16, the applicator rod 12, the cap 14, the rivet member 18, and each other component of the molded brush assembly 10 can be crafted in a variety of colors and from any suitable material. In certain practices of the invention, the material for the rivet member 18, the applicator rod 12, and possibly other components can be formed from polycetal or Polyoxymethylene (POM), a high strength engineering plastic that exhibits low moisture absorption. POM has been found to be advantageous for its excellent chemical resistance, including when used with relatively harsh mascara products. In some embodiments, the cap 14 could be formed from acrylonitrile butadiene styrene (ABS), metal, or any other suitable material. The body 32 of the bottle 30 can in certain cases be formed from polypropylene. The wiper 38 can be molded from the thermoplastic low-density polyethylene (LDPE), high-density polyethylene (HDPE), a thermoplastic elastomer (TPE), or thermoplastic urethane (TPU).

Under the present invention, the tubular core member 44 and the radially projecting bristles 46 can be unitarily molded as a single piece and potentially in a single molding operation. The molded brush sleeve 16 can be molded in a soft material, such as a thermoplastic elastomer (TPE), rubber, or another soft resin. TPE and other advanced materials can have particular suitability and advantages for the present application over materials common to the prior art. For example, mascara and other products have a tendency to cling to nylon bristles and to clump after repeated uses. With TPE and similar materials, the product usually wipes clean during application even after repeated uses.

It will again be noted that the softness of the bristle material represents an advantage when applying the product. However, if the whole rivet 18 and applicator rod 12 were molded in this same material, the rivet 18 and applicator rod 12 would tend to bend during application. Advantageously, by inserting a separate rivet member 18 through the center of the brush sleeve 16, the flexibility of the brush sleeve 16 and bristles 46, of the rivet member 18, and of the applicator rod 12 can each be selectively chosen to suit the circumstances.

Despite the advantageous characteristics of TPE and similar materials, there are shortcomings as well. Since they are soft, they do pose problems with assembly. TPE also does not have excellent chemical resistance capabilities when in contact with certain harsher modern mascara products. It tends to swell slightly when in contact with harsh mascara products over time, which could cause loosening and, in extreme circumstances, separation. The brush assembly 10 disclosed herein, however, seeks to overcome these problems. For example, the flange 42 on the distal tip of the rivet member 18 holds the brush sleeve 16 in place and eliminates the risk of its becoming inadvertently dislodged.

A better understanding of the brush sleeve 16 can be had with further reference to FIGS. 7 through 11. As previously described, the brush sleeve 16 is founded on a tubular core member 44 that is integrally formed with radiating bristles 46. In the depicted embodiment, the bristles 46 are disposed in symmetrical rows spaced radially around the core member 44 and longitudinally aligned in symmetrical columns along the length of the core member 44. The bristles 46 are evenly spaced at 30° intervals such that column $C_2$ is spaced 30° from column $C_1$ and column $C_3$ is spaced 60° from column $C_1$ and so on for twelve evenly spaced columns. In this example, there are twenty evenly spaced rows $R_1$, $R_2$, $R_3$ with bristles 46 centered in planes separated by approximately 1.3 mm (0.051 inches). The bristles 46 in the proximal sixteen rows are substantially identical in length while the distal four rows of bristles 46 taper in length along a 15° cone.

It would be possible for bristles 46 according to certain applications of the invention to have substantially any cross section. However, for optimal product retention and application, this presently preferred embodiment employs faceted bristles 46. More particularly, the bristles 46 have a diamond-shaped cross section from their bases to their tips as can be seen, for example, in FIGS. 10 and 11. The diamond-shaped bristles 46 are identically oriented in relation to the core member 44 with first and second opposed corners longitudinally aligned in relation to the core member 44 and third and fourth opposed corners circumferentially aligned in relation to the core member 44. With the faceted surfaces presented by the diamond-shaped cross section, it is believed product retention and payoff can be improved. For example, the flat surfaces between the corners can retain product, and the corners can primarily contact the hair or other surface as the brush assembly 10 is drawn therethrough.

It is known that some brush shapes perform better with some mascara product formulations than with others. For example, some brush shapes are said to be preferred for lengthening lashes and others are argued to be better for thickening lashes. There are many, many claims, and the viscosity of the product and the formulations differ in many ways. Advantageously, under the present invention, the shape of the brush sleeve 16 can be easily changed by changing the cross sectional shape of the rivet member 18. With this, the exterior shape of the brush sleeve 16 can be readily varied while only changing the construction of one component, the rivet member 18, while the remaining components, including the brush sleeve 16 and the applicator rod 12, remain unchanged thereby minimizing tooling cost and other manufacturing and assembly issues.

For example, as shown in FIG. 12A, embodiments are contemplated with a rivet member 18 having a body portion with a rounded square profile that, when combined with a flexible brush sleeve 16, yields a brush assembly 10 with a rounded square brush portion. Further embodiments are possible with rivet members 18 having rounded triangle, rounded rectangle, and oval cross sections that yield brush assemblies 10 with rounded triangle, rounded rectangle, and oval cross sections, respectively, as shown in FIGS. 12B through 12D. Similarly, the shape of the rivet member 18 can be longitudinally varied or contoured away from being merely straight, such as by being curved, to cause the standard brush sleeve 16 to pursue essentially the corresponding curved configuration of the brush assembly 10 as shown in FIG. 13.

Under the present invention, therefore, the cross-sectional and profile shapes of the soft brush sleeve 16 can be changed simply by changing the shape of the rivet member 18, whether in cross section, profile, or both. One need not employ a unique brush sleeve mold every time the shape of the brush sleeve 16 is to be changed. Furthermore, employing variations in the shape of the rivet member 18 to control the resultant shape of the brush sleeve 16 enables shapes to be achieved that could not be produced at all or in a commercially reasonable manner on a production tool due to the highly complicated nature of the tooling required to produce molded bristles protruding in different directions. Such tooling must be designed to open in different directions thereby imposing substantial, inherent design limitations. Adding a curved or other profile to the already complex brush bristle molding process would push the design out of the realm of commercial or actual possibility in the primary production tool.

An alternative brush assembly 10 according to the present invention is depicted in FIGS. 14 through 16D. There, the applicator rod 12 has a support stem 48 forming the distal portion thereof, such as being integrally formed therewith. The support stem 48 terminates in a widened shoulder 52 at the proximal end thereof. A peripheral wall 54 extends distally from the shoulder 52 to sandwich the proximal end of the brush sleeve 16 between the peripheral wall 54 and the support stem 48 thereby protecting the brush sleeve 16 as described above. A borehole or rod hole 56 is formed in the distal end of the support stem 48 for receiving a rivet 50 that can be secured in place by any suitable means, including friction, mechanical engagement, or heat or ultrasonic welding. With this, a brush sleeve 16, which can have a length generally equal to the length of the support stem 48, can be slid onto the support stem 48 and then retained thereon by an insertion of the rivet 50 into the rod hole 56. Relative rotation between the brush sleeve 16 and the applicator rod 12 can be prevented by ribs 55 on the support stem 48.

Under this arrangement, the configuration in which the brush sleeve 16 is disposed can be manipulated by employing applicator rods 12 with support stems 48 of different longitudinal profiles and, additionally or alternatively, varied lateral cross sections. For example, a support stem 48 with an arcuate longitudinal profile as shown in FIG. 15A will yield a brush assembly 10 with a brush sleeve 16 having a correspondingly arcuate longitudinal profile. Likewise, support stems 48 with oval, rounded rectangle, rounded triangle, and rounded square cross sections will respectively yield brush assemblies 10 having corresponding cross sections as shown in FIGS. 16A through 16D.

With certain details of the present invention for a brush assembly with a molded brush sleeve disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. A brush assembly with a brush sleeve for applying a product comprising:

an applicator rod with a proximal end for being retained by a user and a distal end for applying the product;

a brush sleeve with a tubular core member and a plurality of bristles that project radially from the core member wherein the tubular core member and the plurality of bristles are integrally formed;

a rod hole formed in the applicator rod adjacent to the distal end of the applicator rod;

a rivet with a flange at a distal end thereof and a base portion received into the rod hole in the applicator rod;

a peripheral retaining wall that extends distally from the applicator rod wherein a proximal end of the brush sleeve is received within the peripheral retaining wall and wherein the peripheral retaining wall has a consistent lateral inner dimension and wherein at least the proximal end portion of the brush sleeve has a consistent lateral outer dimension;

whereby the brush sleeve is retained in relation to the applicator rod by the rivet and whereby the proximal end of the brush sleeve can be received and retained by the peripheral retaining wall.

2. The brush assembly of claim 1 wherein the rivet has a main body portion that is disposed distal to the rod hole and that is slidably received through the tubular core member of the brush sleeve.

3. The brush assembly of claim 2 wherein the brush sleeve has a length approximately equal to a length of the main body portion of the rivet exclusive of the flange.

4. The brush assembly of claim 3 wherein the peripheral retaining wall extends distally from the applicator rod from around the rod hole.

5. The brush assembly of claim 4 wherein the peripheral retaining wall has an annular inner surface with an inner diameter sized to receive an outer diameter of the tubular core member of the brush sleeve and wherein the tubular core member of the brush sleeve has an inner diameter sized to receive a longitudinally corresponding outer diameter of the main body portion of the rivet.

6. The brush assembly of claim 4 wherein the length of the brush sleeve is greater than a distance by which the main body portion of the rivet, exclusive of the flange, projects beyond a distal end of the retaining wall when the base portion of the rivet is fully received into the rod hole.

7. The brush assembly of claim 6 wherein the length of the brush sleeve is greater than the distance by which the main body portion of the rivet, exclusive of the flange, projects beyond the distal end of the retaining wall by approximately a height of the retaining wall.

8. The brush assembly of claim 1 wherein the plurality of bristles that project radially from the tubular core member of the brush sleeve each have a diamond-shaped cross section.

9. The brush assembly of claim 8 wherein the plurality of bristles are oriented in relation to the tubular core member with first and second opposed corners longitudinally aligned in relation to the core member and third and fourth opposed corners circumferentially aligned in relation to the core member.

10. The brush assembly of claim 9 wherein the plurality of bristles are disposed in symmetrical rows spaced radially around the core member and longitudinally aligned in symmetrical columns along the core member.

11. The brush assembly of claim 1 wherein the rivet has a base portion for being inserted into the rod hole and a main body portion that is disposed distal to the rod hole that is slidably received through the tubular core member of the brush sleeve and wherein the main body portion of the rivet has a non-circular cross section whereby the tubular core member of the brush sleeve will tend to pursue the non-circular cross section of the main body portion of the rivet.

12. The brush assembly of claim 1 wherein a distal portion of the applicator rod comprises a support stem, wherein the rod hole is formed in a distal end of the support stem, and wherein the brush sleeve is slidably received onto the support stem and retained by the rivet inserted into the rod hole.

13. The brush assembly of claim 12 wherein the support stem has a non-circular lateral cross section whereby the tubular core member of the brush sleeve will tend to pursue the non-circular lateral cross section of the support stem.

14. The brush assembly of claim 13 wherein the non-circular lateral cross section of the support stem is chosen from the group consisting of a rounded triangular lateral cross section, a rounded rectangular lateral cross section, and a rounded square lateral cross section.

15. The brush assembly of claim 12 wherein the support stem has an arcuate longitudinal profile whereby the tubular core member of the brush sleeve will tend to pursue the arcuate longitudinal profile of the support stem.

16. The brush assembly of claim 12 wherein the support stem terminates at a proximal end thereof in a widened shoulder and wherein the peripheral retaining wall extends distally from the widened shoulder around the proximal end of the support stem.

17. A method for producing plural brush assemblies according to claim 1, the method comprising the following:

for each brush assembly, providing the applicator rod with a rod hole formed in the applicator rod adjacent to the distal end of the applicator rod, providing the brush sleeve, providing the rivet, and securing the brush sleeve in relation to the applicator rod by inserting the rivet into the rod hole.

18. The method for producing brush assemblies of claim 17 wherein the rivet of each brush assembly has a base portion for being inserted into the rod hole and a main body portion that is disposed distal to the rod hole for being slidably received through the tubular core member of the brush sleeve and wherein the main body portions of the rivets of at least some brush assemblies have a non-circular cross section whereby the tubular core members of the brush sleeves of those brush assemblies will tend to pursue the non-circular cross sections of the main body portions of the rivets.

19. The method for producing brush assemblies of claim 18 further comprising the steps of producing at least some brush assemblies with main body portions of the rivets with round cross sections and producing at least some brush assemblies with main body portions of the rivets with non-circular cross sections.

20. The method of claim 17 wherein a support stem comprises a distal portion of the applicator rod of each brush assembly, wherein the rod hole in each brush assembly is formed in a distal end of the support stem, and wherein the brush sleeve of each brush assembly is slidably received onto the support stem and retained by the rivet inserted into the rod hole and wherein the support stems of at least some brush assemblies have non-circular cross sections whereby the tubular core members of the brush sleeves of those brush assemblies will tend to pursue the non-circular cross sections of the support stems.

21. The method of claim 20 further comprising the steps of producing at least some brush assemblies with support stems with round cross sections and producing at least some brush assemblies with support stems with non-circular cross sections.

* * * * *